US005301491A

United States Patent [19]

Boardman, Jr. et al.

[11] Patent Number: 5,301,491

[45] Date of Patent: Apr. 12, 1994

[54] METHOD OF PACKAGING A CHAIR FOR SHIPMENT

[75] Inventors: John K. Boardman, Jr., Bedford; Garmon W. Conner, Check; B. Douglas Brockman, Lynchburg, all of Va.

[73] Assignee: Sam Moore Furniture Industries, Inc., Bedford, Va.

[21] Appl. No.: 835,346

[22] Filed: Feb. 14, 1992

[51] Int. Cl.[5] ..... B65B 5/00

[52] U.S. Cl. ..... 53/428; 53/452; 53/473

[58] Field of Search ..... 53/473, 474, 475, 449, 53/428, 429, 452

[56] References Cited

U.S. PATENT DOCUMENTS 4,570,417 2/1986 Herr ..... 53/473 X 4,934,126 6/1990 Wiegand et al. ..... 53/474 X

*Primary Examiner*—James F. Coan

*Attorney, Agent, or Firm*—Mason, Fenwick & Lawrence

[57] ABSTRACT

A chair has a removable back portion and a base portion connectable by unique female/male tapered connectors attached to the base portion and back portion with the base portion being shaped and dimensioned to be received in a carton having a tapered rear portion provided by diagonal vertical panels on opposite sides of a rear vertical wall panel with the base carton being shaped and dimensioned so that the sum of its girth and height do not total more than 130 inches so that the carton can be shipped by a parcel service shipping company such as UPS rather than by regular freight with the back being separately shipped in a separate package so that total shipping charges are much less than regular freight charges.

12 Claims, 6 Drawing Sheets

METHOD OF PACKAGING A CHAIR FOR SHIPMENT

BACKGROUND OF THE INVENTION

The present invention is directed to the fields of furniture and shipment containers and methods therefor.

More specifically, the present invention is directed to a unique method of assembling and shipping chairs in cartons or boxes for that purpose. Even more specifically, the subject invention is directed to a unique method and apparatus for permitting the shipping of chairs at a cost substantially less than that required when using previously employed shipping procedures. Even more specifically, the subject invention is directed to a method and apparatus for packing chairs in cartons of a sufficiently small size so as to permit the cartons to be acceptable to United Parcel Service for shipment thereby at substantially lower rates than is possible with other previously employed shipping procedures.

Chairs and similar furniture items are of such a geometric configuration as to require relatively large rectangular or square conventional boxes or cartons for enclosing such items for shipment; such cartons or boxes consequently both enclose and occupy substantial volumes of waste space in addition to the space being occupied by the chair. Since the shipping rates charged by motor carriers and others are proportional to the volume of the carton enclosing the item being shipped, the conventional cartons in which chairs are shipped result in substantial freight charges due to the fact that their total internal volume is necessary substantially greater than the volume of the chair enclosed within such cartons or boxes. For example, the shipping charge for chairs sold by catalogue stores and delivered by a conventional motor freight can be as high as $90.00. On the other hand, United Parcel Service shipping charges are based upon the weight of the shipped item with the rate being substantially less than that of most other shipping companies. However, United Parcel Service (UPS) will only ship packages or cartons of the like of a shape and size that of relatively small volume which is substantially less than the minimum size rectangular boxes and cartons in which chairs or the like have been previously shipped. The United Parcel Service rule is that a carton or box must not weigh more than 70 pounds or be so dimensioned that the sum of the girth (the perimeter as measured adjacent the top of the box) and the height of the box or carton must not exceed 130 inches. However, until the present invention, full size chair manufacturers could not meet the 130 inch requirement of United Parcel Service.

Up until the present invention, chair manufacturers of adult size chairs have universally employed common carrier shipping such as motor freight carriers for shipping purposes; similarly, retailers normally use either their own in-house delivery and/or local independent delivery companies. In either event shipping and delivery expenses are substantial and far in excess of what would have been possible had they been able to use United Parcel Service for the shipment of such adult size chairs. Moreover, shipping and delivery time using common carrier and normal retail delivery channels normally takes from one to five weeks. Conversely, UPS will normally accomplish delivery in two to five working days. However, up until the present invention, adult size chairs could not be shipped by UPS due to the restrictive size and weight limitations discussed above.

Therefore, it is the primary object of the present invention to provide a new and improved method and structure for permitting the shipment of adult size chairs by United Parcel Service.

A further object of the present invention is a provision of a new and improved method permitting an adult size chair to be packed in cartons of sufficiently small dimensions as to permit their shipment by United Parcel Service.

Yet another object of the invention is the provision of chair shipping apparatus and method in which waste volume in the shipping container is substantially reduced.

SUMMARY OF THE INVENTION

The subject invention achieves the foregoing objects by the employment of a unique chair construction in combination with a unique chair base receiving box or carton of reduced size in comparison with prior known boxes or cartons used for shipping chairs. The chair design employs means permitting the back of the chair to be separated from the chair base so that the two chair components can be shipped separately but can be easily assembled upon arrival at their destination.

The unique chair base receiving carton is dimensioned so that its vertical front, rear and side walls are not arranged in the shape of a square or a rectangle as viewed from above but are instead provided with beveled rear corners which generally follow the configuration of the rear portion of the chair base so that the chair is essentially matingly received in the chair base carton the top of which is then closed to snugly hold the chair base with a minimum of waste dead space. The chair base carton and the enclosed chair base are then within the size and weight limitations required by UPS so that the chair base can be shipped by United Parcel Service. On the other hand, the removable chair back is shippable in a separate conventional rectangular carton or box which easily falls within the requirements of UPS. It is consequently possible to ship the chair in two cartons at a cost that is substantially less than would the cost for a conventional shipment of the entire chair in a separate conventional rectangular or square carton.

In practice, the subject invention permits the retailer to take the customer's custom order specifying specific styles, fabric and the like. The order is then transmitted to the manufacture who then ships the chair by UPS directly to the customer Thus, the customer gets quicker delivery and the retailer reduces shipping costs while also being able to reduce or even avoid the expense of receiving, maintaining, warehousing and insuring inventory.

A better understanding of the preferred embodiment of the invention will be achieved when the following detailed written description is considered in conjunction with the appended drawings in which like reference numerals are used for the same parts as illustrated in the different drawing figures.

DESCRIPTION OF THE PREFERRED EMBODIMENT

Figure 7:
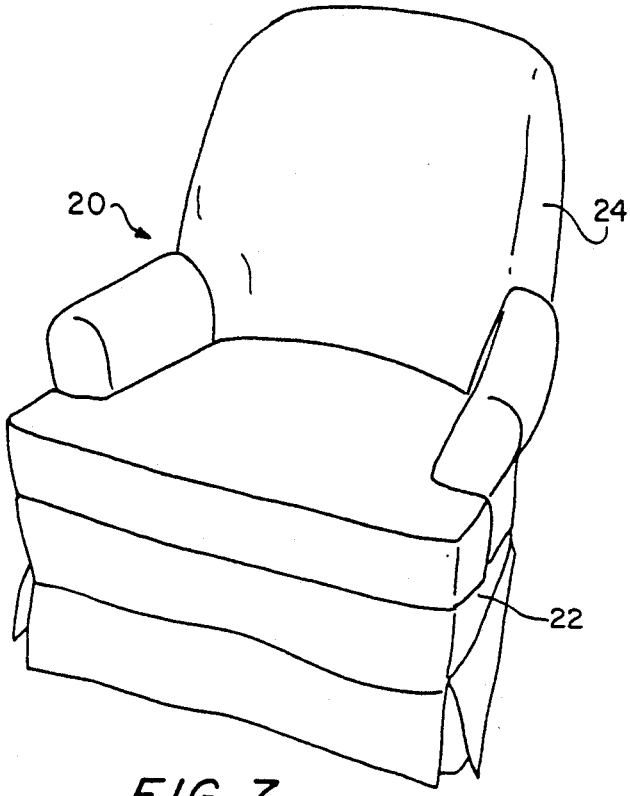
FIG. 7 is a front prospective view of a chair embodying various aspects of the present invention.
Figure 8:
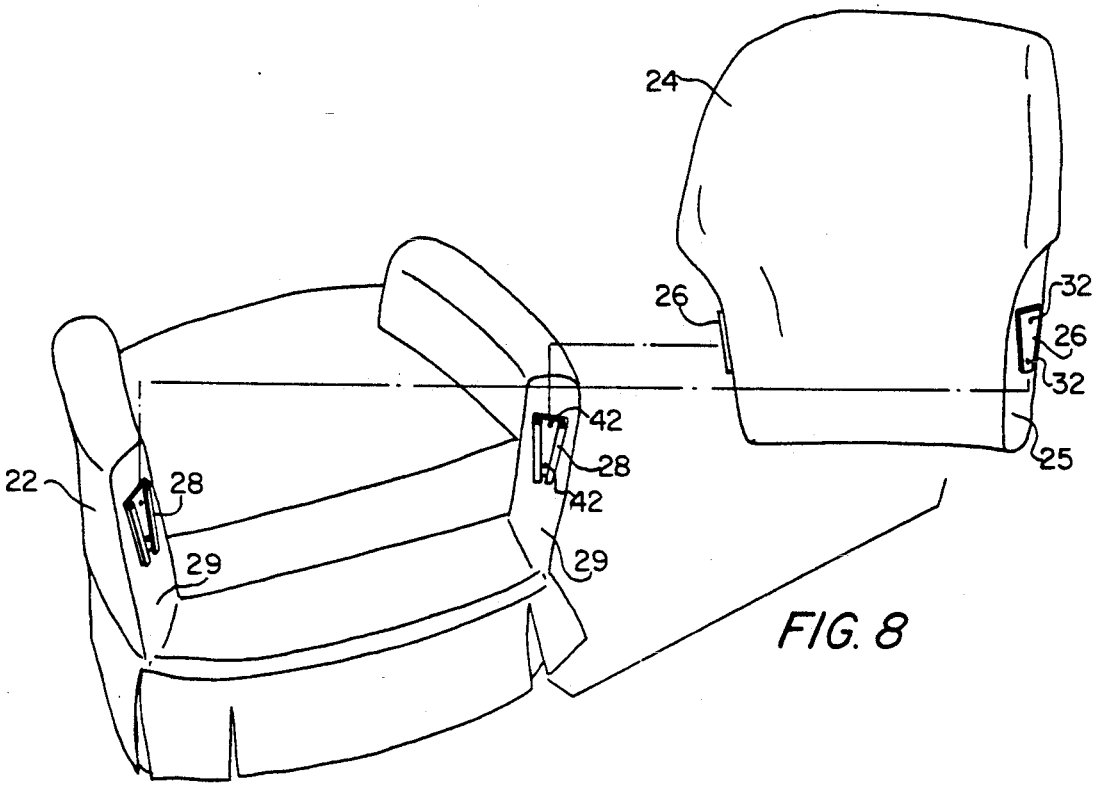
FIG. 8 is an exploded rear prospective view of the chair of FIG. 7 showing the chair base and the chair back components in separated condition.

Attention is initially invited to FIG. 7 of the drawings which illustrates the preferred embodiment chair 20 used in practice of the invention. Chair 20 includes a chair base component 22 which is of curved non-square configuration as viewed from above and a chair back component 24 as shown in FIG. 7 which are manufactured as separate items as shown in FIG. 8. The separate chair back component and chair base components are connectable by means of first and second tapered male connector members 26 respectively mounted on opposite sides of the chair back component and first and second tapered female connector members 28 respectively mounted on the chair base component to matingly receive the male connector members 26 which are first positioned immediately above the female connector members and then forcibly moved downwardly to snugly enter and engage the female connector members 28.

Each of the tapered male connector members 26 (FIG. 9) comprises a steel plate having a plurality of mounting apertures 30 through which screws 32 (FIG. 8) extend for attachment of the tapered male connector member 26 to the sides of the chair back 24 shown in FIG. 8. A spacer member 34 protrudes from the lower end of the tapered male connector member 26 and engages the side surface 25 (FIG. 8) of the chair back component so that the lower end 36 of the tapered male connector member 26 is spaced away from the surface 25 so that it is aligned with and can easily enter the open upper end of the female connector member 28.

Figure 9:
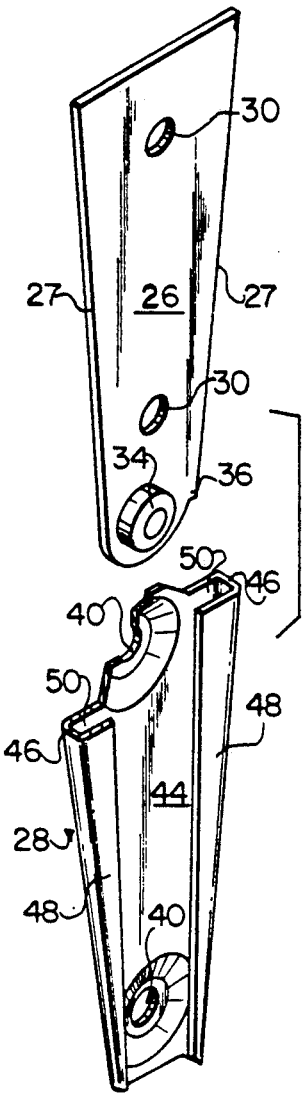
FIG. 9 is an exploded prospective view illustrating the preferred connector components for permitting the chair back to be connected to the chair base.
Figure 11:
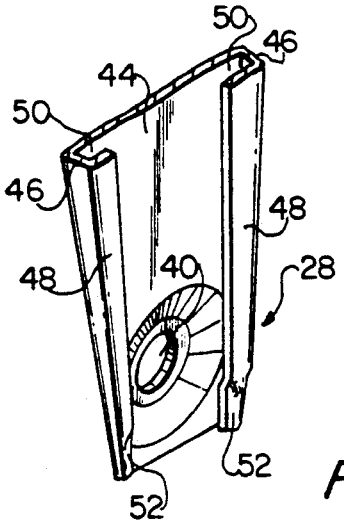
FIG. 11 is a an enlarged view of the connector means illustrating the details of means for snugly retaining the chair base and chair back components in connected position.

The female connector member 28 includes countersunk screw receiving mounting apertures 40 in which screws 42 are provided for attachment of the tapered female connecting member 28 to the rear surfaces 29 of the chair base component 22. Additionally, each tapered female connector member 28 includes a base plate 44 in which the countersunk apertures 40 are provided, two side plates 46 oriented perpendicularly to base plate 44 define the side edges of the female connector member and two retainer flanges 48 which extend inwardly from the outer edges of the side plates 46 and are parallel to base plate 44 to define slots 50 extending along each side edge of each tapered female connector member 28 as best shown in FIGS. 9 and 11. The outer side edge surfaces 27 of each tapered male connector member 26 are received in one of the slots 50 and are snugly but removably retained therein by virtue of the fact that the lower end of each of the retainer flanges 48 includes an inwardly protruding dimple 52 illustrated in the enlarged view of FIG. 11 which reduces the distance between the retainer flange 48 and the surface of base plate 44 to more snugly grip the lower ends of the side edges 27 of the male connector 26 to provide a frictional hold on the tapered male connector member for snugly retaining it in its lowermost position within the female connector member 28. However, the frictional force between the dimple portions 52 of retainer flanges 48 and the male connector member can be overcome if it is desired to remove the back of the chair from the chair base for any purpose.

Figure 10:
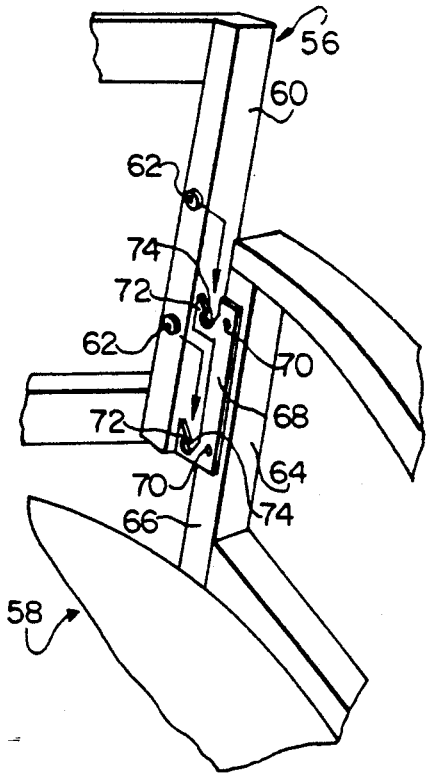
FIG. 10 is a prospective view of an alternative method of connecting the chair back portion to the chair base portion.

FIG. 10 illustrates an alternative method of connecting the chair back component to the chair base component. More specifically, in the embodiment of FIG. 10 the chair back component has a frame 60 in which a pair of male connector members in the form of spaced cap screws 62 are positioned with their heads spaced a discrete distance from the surface of frame 60. The chair base 58 component has a vertical frame member 64 on each side in the arm portion of the chair base (only one frame member 64 being illustrated in FIG. 10). Each vertical frame member 64 has an inner surface 66 to which a retainer plate 68 is mounted by screw means 70 in an obvious manner. Retainer plate 68 includes first and second vertically spaced female connector pairs comprising hook components 72 providing downwardly and rearwardly sloping slots 74 into which the shaft of each of the cap screws is received for retention therein. The heads of the cap screws 62 are of a diameter exceeding the width of each slot 74 and the retainer plate is of a thickness no greater than the discrete distance the head of each screw 62 is spaced from the surface of frame 60. Consequently, the chair back is attached to the chair base 58 by first positioning the cap screws 62 over the slots 74 following which the cap screws 62 and the chair back are forcefully moved downwardly and rearwardly to move the cap screws to the bottom of each slot 74 in which position they are snugly held due to compression of upholstery material between the frame components 60 and 64 to maintain the chair back component 56 in position on the chair base component 58 in an obvious manner. Removal of the chair base component from the chair back component consequently requires the application of both a forward and upward force to the chair back component.

Figure 1:
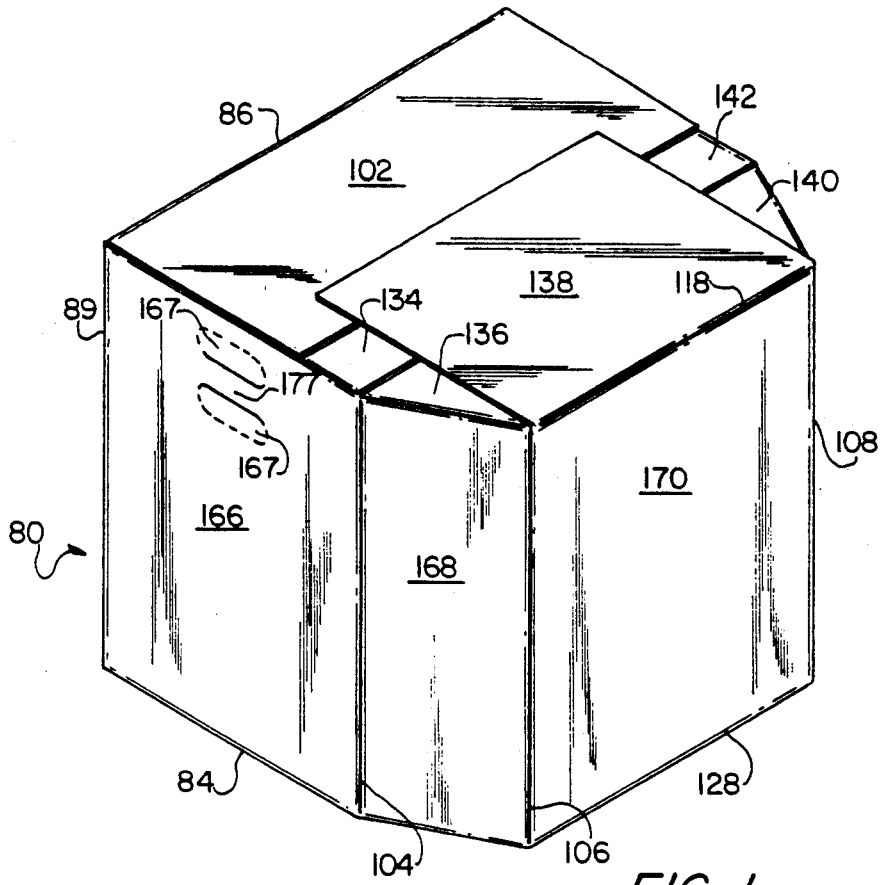
FIG. 1 is a rear prospective view of the chair base carton employed in practice of the invention.
Figure 2:
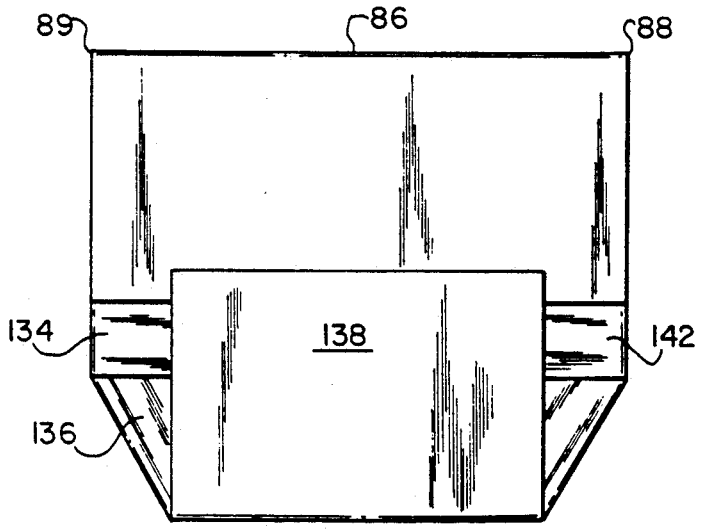
FIG. 2 is a top plan view of the chair base carton.
Figure 5:
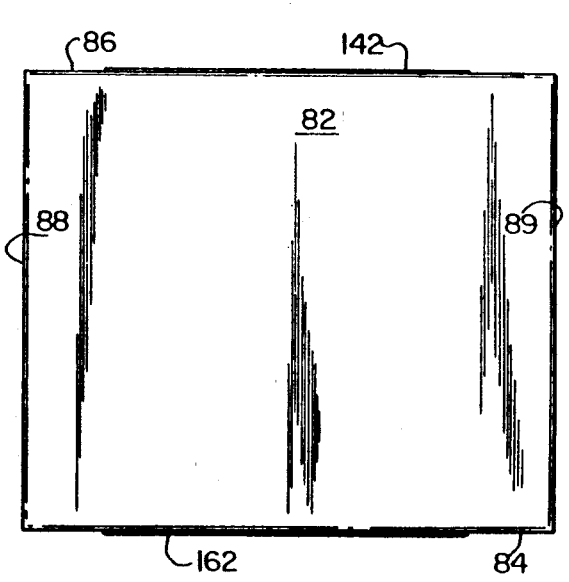
FIG. 5 is a front elevation view of the chair base carton.
Figure 4:
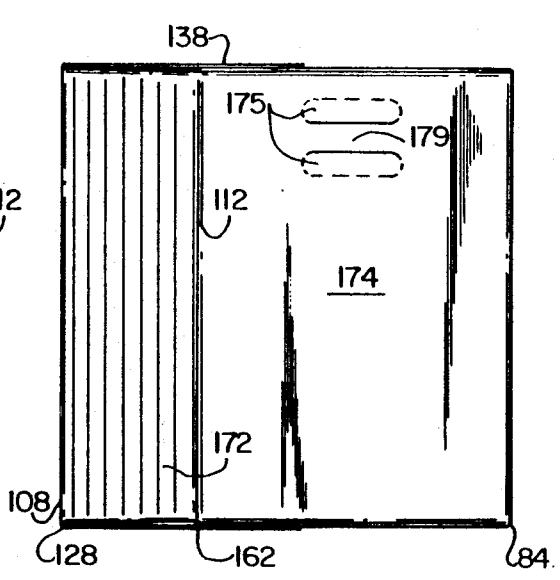
FIG. 4 is a right side elevation view of the chair base carton.
Figure 3:
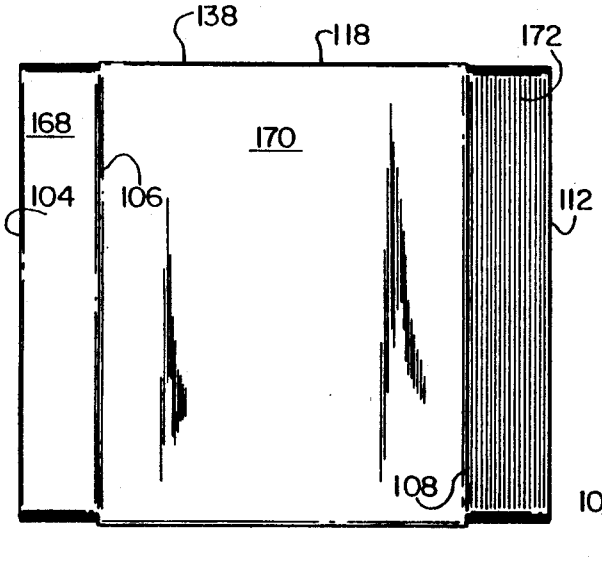
FIG. 3 is a rear elevation view of the chair base carton.
Figure 6:
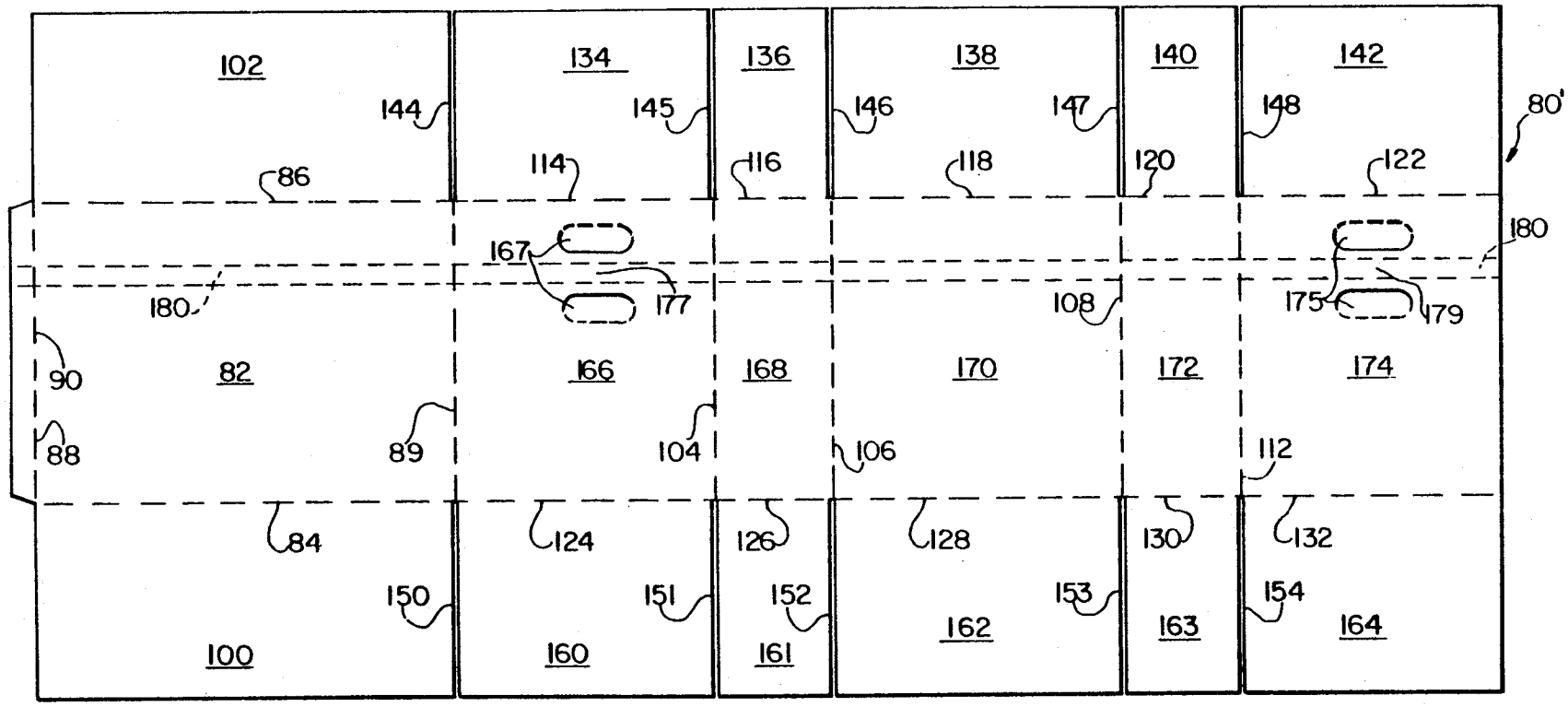
FIG. 6 is a plan view of a corrugated cardboard blank from which the chair base carton of FIGS. 1 through 5 is formed.

A significant component of the invention comprises a chair base receiving carton or box generally designated 80 which is formed of a 275 lb. test corrugated cardboard that is three-sixteenths of an inch thick (3/16"). The carton 80 is formed from a blank 80' (FIG. 6) and includes a front vertical wall panel 82 (FIGS. 5 and 6) extending between a lower fold line 84 and an upper horizontal fold line 86 and a left (as viewed in FIG. 5) vertical fold line 88 and a right vertical fold line 89. A connector glue tab 90 is connected to front panel 82 along left vertical fold line 88 as shown in FIG. 6. Similarly, a front bottom panel 100 is connected to front vertical wall panel 82 along lower fold line 84 and a front top panel 102 is similarly connected to front vertical wall panel 82 along upper fold line 86. Additional vertical fold lines 104, 106, 108, and 112 are provided in the carton blank along with upper horizontal fold lines 114, 116, 118, 120 and 122. Similarly, lower horizontal fold lines 124, 126, 128, 130 and 132 are provided along the lower surface of the carton.

The carton blank 80' additionally includes a right top panel 134, a right diagonal top panel 136, a rear top panel 138, a left diagonal panel 140 and a left top panel 142. Upper cutout slots 144, 145, 146, 147 and 148 have a width of ⅜" and are provided for separating the panels 102, 134, 136, 138, 140 and 142. Similarly, the carton includes lower ⅜" cutout slots 150, 151, 152, 153 and 154 which provide separation between front bottom panel 100, a right bottom panel 160, a right diagonal bottom panel 161, a rear bottom panel 162, a left diagonal bottom panel 163 and a left bottom panel 164.

Lastly, the carton includes a right side vertical wall panel 166 in which right butterfly access openings 167 are provided, a right vertical diagonal beveled wall panel 168, a vertical wall rear panel 170, a left vertical diagonal beveled panel 172 and a left side vertical wall panel 174 in which left butterfly access openings 175 are provided. The butterfly access openings 167 and 175 can be pushed inwardly of the carton to provide strong hand handholds 177 and 179 for permitting easy lifting of the chair base carton 80. It should also be noted that a strip of mylar reinforced tape 180 extends about the periphery of the inner surface of the vertical panels 82, 166, 168, 170, 172 and 174 of the carton 80 and is positioned on the rear surface of handholds 177 between the two butterfly flaps 167 and similarly between the two butterfly flaps 175 and on the rear of handhold 179 so that force applied to the handholds between the adjacent parallel butterfly flaps when lifting the carton will be absorbed by the tape 180 and the handholds will not be torn or damaged.

It should also be noted that the right vertical diagonal bevelled wall panel 168 and the left diagonal vertical bevelled wall panel 172 are symmetrical relative to a vertical plane of symmetry passing through the mid points of front vertical wall panel 82 and rear vertical wall panel 170 (i.e. midway between fold lines 89 and 90 and also midway between fold lines 106 and 108).

Figure 12:
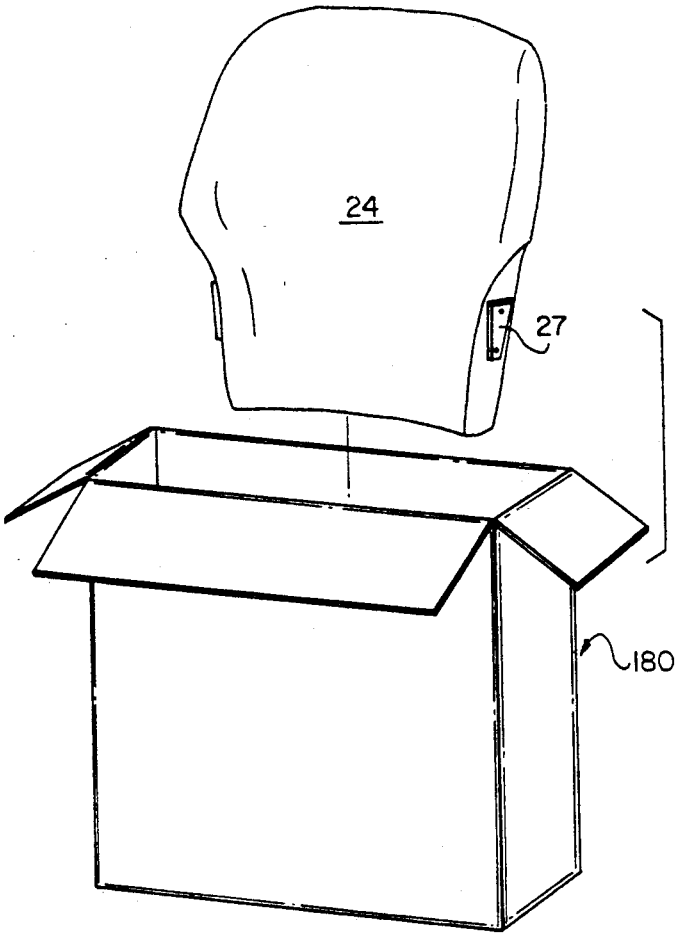
FIG. 12 is an exploded prospective view of a chair back carton and the associated chair back component which is positioned therein.
Figure 13:
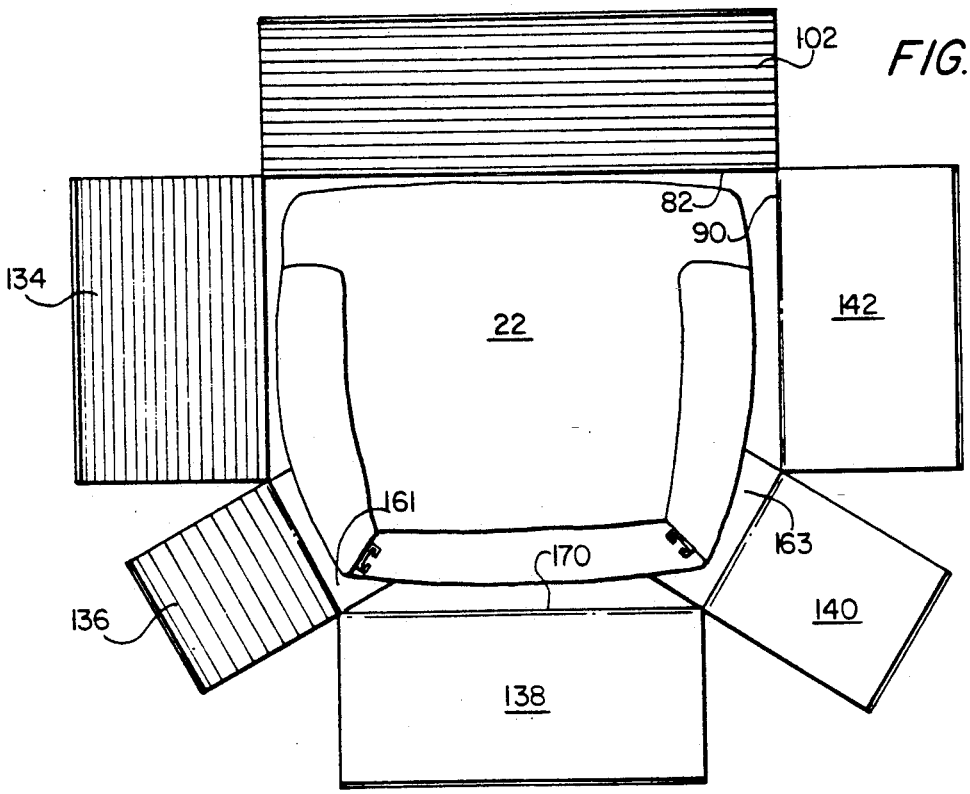
FIG. 13 is a plan view illustrating the manner in which the chair base component is positioned in the chair base carton prior to closure of the carton.

A conventional rectangular chair back component receiving carton or box 180 that is formed of the same type corrugated cardboard as the chair base carton or box 80 is approximately 30 inches high, 27½ inches wide and 11 inches deep is provided for receiving the chair back component 24 in the manner illustrated in FIG. 12. The chair base component 22 is received in the carton or box 80 in the manner illustrated in FIG. 13. It should be noted that the clearance between the outer surface of the chair base component 22 and the inner walls of carton 80 as shown in FIG. 13 is exaggerated in order to more clearly illustrate the components and that in many instances the outer surfaces of the chair base 22 will actually contact the inner surfaces of the carton panels 82, 166, 168, 170, 172 and 174. Both the chair back component 24 and the chair base component 22 are normally covered with a conventional wrapping material prior to being placed in cartons or boxes 180 and 80.

Fold lines 86, 114, 116, 118, 120 and 122 of carton blanks 80' are all aligned with each other and are spaced 21 15/16 inches from fold lines 84, 124, 126, 128, 130 and 132 which are also aligned with each other and form part of a single line; consequently, the finished carton 80 has a height of approximately 21⅝ inches. Front panel 82 is approximately 30¼ inches wide; rear panel 170 is approximately 21⅝ inches wide; right side panel 166 and left side panel 174 are approximately 18 9/16 inches wide and diagonal beveled panels 168 and 172 are approximately 8¾ inches wide.

It should be understood that while preferred embodiments of the invention are disclosed, the spirit and scope of the invention is not limited to the disclosed embodiments and is limited solely by the language of the following claims.

We claim:

1. A method of preparing a chair having a curved non-square rear configuration and a separable chair back component and chair base component for shipment, said method comprising the steps of:

(a) providing the chair back component and the chair base component in separated condition;

(b) positioning the chair base component in a closeable chair base carton having vertical wall means having a peripheral dimension that is substantially less than the peripheral dimension of a square carton in which said chair base component would be snugly received and a height permitting complete enclosure of the chair base component; and (c) positioning the chair back in a chair back carton of sufficient size to fully enclose the chair back.

2. The method of claim 1 wherein said closeable chair base carton of step (b) includes a front vertical wall panel; a right side vertical wall panel; a left side vertical wall portion and a rear wall assembly including a rear vertical wall panel having right and left sides and being of less width than said front vertical wall panel, a right vertical diagonal beveled wall panel connecting the right side vertical wall panel to the rear vertical wall panel and a left vertical diagonal beveled wall panel connecting the left side vertical wall panel to the right side of the rear vertical wall panel.

3. The method of claim 2 wherein the sum of the periphery of the vertical walls and the height of any of the vertical walls is no more than 130 inches.

4. The method of claim 3 where said chair back carton is of rectangular configuration.

5. The method of claim 4 wherein said chair base carton includes horizontal bottom panel means and horizontal top panel means.

6. The method of claim 1 wherein the sum of the girth and height of the chair base carton does not appreciably exceed 130 inches.

7. The method of claim 6 wherein said closeable chair base carton of step (b) includes a front vertical wall panel; a right side vertical wall panel; a left side vertical wall portion and a rear wall assembly including a rear vertical wall panel having right and left sides and being of less width than said front vertical wall panel, a right vertical diagonal beveled wall panel connecting the right side vertical wall panel to the rear vertical wall panel and a left vertical diagonal beveled wall panel connecting the left side vertical wall panel to the right side of the rear vertical wall panel.

8. The method of claim 7 wherein said right vertical diagonal beveled wall panel and said left vertical diagonal bevelled wall panel are symmetrically positioned relative to a front to rear extending plane of symmetry oriented perpendicular to said front vertical wall panel and said rear vertical wall panel.

9. The method of claim 1 wherein said closeable chair base carton includes;

(a) a front vertical wall panel having a right side and a left side;

(b) a right side vertical wall panel extending rearwardly from said right side of said front vertical wall panel;

(c) a left side vertical wall panel extending rearwardly of said left side of said front vertical wall panel;

(d) a rear vertical wall panel oriented in a plane substantially parallel to said front vertical wall panel and having a right side and a left side;

(e) a right vertical diagonal beveled wall panel extending between said right side vertical wall panel and said rear vertical wall panel;

(f) a left vertical diagonal beveled wall panel extending between said right side vertical wall panel and said rear vertical wall panel;

(g) carton top defining means; and (h) carton bottom defining means.

10. A method as recited in claim 9 wherein said right diagonal beveled wall panel and said left diagonal beveled wall panel are symmetrically positioned relative to a front to rear extending plane of symmetry oriented perpendicularly to said front vertical wall panel and said rear vertical wall panel.

11. A method of preparing a chair having a curved non-square rear configuration and a separable chair back component and chair base component for shipment, said method comprising the steps of:

(a) providing the chair back component and the chair base component in separated condition;

(b) positioning the chair base component in a closable chair base carton having vertical wall means having a peripheral dimension that is substantially less than the peripheral dimension of a square carton in which said chair base component would be snugly received and a height permitting complete enclosure of the chair base component; and (c) positioning the chair back in a chair back carton of sufficient size to fully enclose the chair back;

wherein said closeable chair base carton includes;

(a) a front vertical wall panel having a right side and a left side;

(b) a right side vertical wall panel extending rearwardly from said right side of said front vertical wall panel;

(c) a left side vertical wall panel extending rearwardly rom said left side of said front vertical wall panel;

(d) a rear vertical wall panel oriented in a plane substantially parallel to said front vertical wall panel and having a right side and a left side;

(e) a right vertical diagonal beveled wall panel extending between said right side vertical wall panel and said rear vertical wall panel;

(f) a left vertical diagonal beveled wall panel extending between said left side vertical wall panel and said rear vertical wall panel;

(g) carton top defining means; and (h) carton bottom defining means;

wherein said right vertical diagonal beveled wall panel and said left vertical diagonal beveled wall panel are symmetrically positioned relative to a front to rear extending plane of symmetry oriented perpendicularly to said front vertical wall panel and said rear vertical wall panel; and wherein said carton top defining means comprises a front top panel joined by a fold line to the upper extent of said front vertical wall panel, a rear top panel joined by a fold line to the upper extent of said rear vertical wall panel, a right top panel joined by a fold line to the upper extent of said right side vertical wall panel, a left top panel joined by a fold line to the upper extent of said left side vertical wall panel, a right diagonal top panel joined by a fold line to the upper extent of said right vertical diagonal beveled wall panel and a left diagonal top panel joined by a fold line to the upper extent of said left vertical diagonal beveled wall panel.

12. A method as recited in claim 11 wherein the sum of the girth of said carton as measured adjacent the upper extent of said carton and the height of said carton does not substantially exceed 130 inches.

* * * * *